US011701916B2

(12) United States Patent
Zambrotta

(10) Patent No.: US 11,701,916 B2
(45) Date of Patent: Jul. 18, 2023

(54) MASON JAR-MOUNTED PAINT BRUSH HOLDER

(71) Applicant: Jeremiah A. Zambrotta, North Babylon, NY (US)

(72) Inventor: Jeremiah A. Zambrotta, North Babylon, NY (US)

( * ) Notice: Subject to any disclaimer, the term of this patent is extended or adjusted under 35 U.S.C. 154(b) by 36 days.

(21) Appl. No.: 17/446,749

(22) Filed: Sep. 2, 2021

(65) Prior Publication Data

US 2023/0065939 A1 Mar. 2, 2023

(51) Int. Cl.
*A46B 17/02* (2006.01)
*B44D 3/12* (2006.01)

(52) U.S. Cl.
CPC ..... *B44D 3/123* (2013.01); *A46B 17/02* (2013.01)

(58) Field of Classification Search
CPC ..... B43M 99/001; B43M 99/008; B43M 99/006; B65D 23/12; B65D 23/065; B44D 3/02; B44D 3/123; A47G 19/065; A46B 17/02
USPC ..... 220/736, 697, 574.1; 206/362, 209, 15.3
See application file for complete search history.

(56) References Cited

U.S. PATENT DOCUMENTS 1,800,855 A 4/1931 Bostrom
1,903,410 A * 4/1933 Cecil ..... A24F 9/14 211/86.01
1,958,022 A * 5/1934 Sheppard ..... B65D 23/12 132/310
2,284,452 A 5/1942 Simons
2,533,354 A * 12/1950 Comfort ..... B44D 3/123 220/697
2,533,355 A * 12/1950 Comfort ..... B44D 3/125 220/254.1
2,566,650 A 9/1951 Anderson
2,744,635 A 5/1956 Hiss
2,864,510 A * 12/1958 Sture ..... A24F 9/14 108/151
2,906,479 A * 9/1959 Strachan ..... A47K 1/09 248/108
2,937,790 A * 5/1960 Lapeyre ..... B05B 11/048 222/94
2,950,012 A 8/1960 Mascarett
2,952,364 A 9/1960 Jacobson
3,039,616 A * 6/1962 Proffit ..... B60N 3/106 211/74
3,156,364 A 11/1964 Wolcott
3,486,630 A * 12/1969 Ellman ..... B65D 83/285 132/289
3,532,222 A 10/1970 Madden
3,899,107 A 8/1975 Gaal
4,020,975 A * 5/1977 Stauffer ..... B65D 83/0027 222/93

(Continued)

*Primary Examiner* — Mollie Impink
(74) *Attorney, Agent, or Firm* — Dunlap Bennett & Ludwig, PLLC; Anna L. Kinney

(57) ABSTRACT

A paint brush holder includes a rigid sheet with a first surface and a second surface. The holder has a ledge surrounding an aperture that accommodates a mouth of a regular mouth mason jar, recessed with respect to the first surface. Grooves extend across a portion of the first surface on a first side of the aperture. Holes extend through the rigid sheet on a second side of the aperture opposite the grooves. The holes have a diameter larger than a smallest diameter of a paint brush handle and smaller than a largest diameter of the paint brush handle.

7 Claims, 4 Drawing Sheets

(56) References Cited

U.S. PATENT DOCUMENTS 4,362,243 A * 12/1982 Deyesso ..... B25H 3/02 206/562
4,695,029 A * 9/1987 Fox ..... B65D 23/12 248/230.1
4,826,007 A * 5/1989 Skeie ..... A63H 33/30 220/524
4,884,701 A * 12/1989 Nymark ..... B43M 99/008 211/69.8
5,016,773 A 5/1991 Lockwood
5,253,768 A * 10/1993 Traversa ..... B44D 3/123 248/110
5,294,000 A * 3/1994 Yanuzzi ..... A47G 19/065 206/557
5,350,065 A * 9/1994 Darrey ..... B25H 3/00 220/735
5,609,259 A * 3/1997 Menard ..... A47K 1/09 211/66
5,938,040 A * 8/1999 Goodwin ..... B43M 99/006 206/214
6,041,919 A * 3/2000 Adams ..... A45D 34/046 220/736
6,138,827 A * 10/2000 Marshall ..... B25H 3/00 220/735
6,168,023 B1 * 1/2001 Cooper ..... A45D 27/22 206/823
6,189,698 B1 * 2/2001 Asser ..... A45D 40/00 206/823
6,268,040 B1 * 7/2001 McArthur ..... A47K 1/09 206/362.1
6,412,735 B1 * 7/2002 Mathieu ..... A47K 1/09 248/110
D461,609 S * 8/2002 Sands ..... D32/54
6,702,141 B1 * 3/2004 Cinque ..... A47G 19/065 220/575
6,823,998 B2 * 11/2004 Fabregas ..... B25H 3/06 211/70.6
7,337,901 B2 * 3/2008 Phillips ..... B25H 3/06 206/349
8,118,157 B1 * 2/2012 Piccolin ..... F42B 4/20 206/564
8,701,899 B2 4/2014 Paga et al.
9,877,574 B1 1/2018 Chih
10,306,976 B2 6/2019 Ranucci
10,479,564 B2 * 11/2019 Li ..... A47G 19/00
D890,458 S * 7/2020 Yearwood, Jr. ..... D32/53
11,396,400 B2 * 7/2022 Shiflett, Jr. ..... B65D 25/20
D969,431 S * 11/2022 Shiflett, Jr. ..... D32/54
2004/0016710 A1 * 1/2004 Kjelgaard ..... B43M 99/006 211/69.5
2004/0181887 A1 9/2004 Smith et al.
2006/0157946 A1 * 7/2006 Stuemke ..... B65F 1/1468 280/79.5
2006/0180559 A1 8/2006 Roberti
2006/0214384 A1 * 9/2006 Gwin ..... B65F 1/1468 280/79.5
2009/0321282 A1 12/2009 Asmaro
2015/0296973 A1 * 10/2015 Leiker ..... A46B 17/06 15/104.92
2018/0215196 A1 8/2018 Stapleton
2018/0264876 A1 9/2018 Davis
2020/0016923 A1 1/2020 LeWan

* cited by examiner

MASON JAR-MOUNTED PAINT BRUSH HOLDER

BACKGROUND OF THE INVENTION

The present invention relates to painting equipment and, more particularly, to mason jar-mounted paint brush holder.

Currently available paint brush holders are clunky; do not provide easy access, clean up, or storage; and are not compact for travel. They do not provide a way to combine holding brushes and water. Water is necessary for cleaning brushes to change color and to also supply a source of hydration for water-based paints.

As can be seen, there is a need for an easy, compact way to take paint brushes and water while traveling.

SUMMARY OF THE INVENTION

The present invention provides a paint brush holder that affixes universally to the top of any mason jar in which to carry a water supply. All the user's brushes may be held with the water supply in the same apparatus, taking up ½ the space of currently available water and brush arrangements. The user may close and pack the jar with its liquid seal cap comprising a lid and a threaded band to transport the water supply and carry the paint brush holder separately for easy travel and set up. For example, the device may be set up in a park or on a city street corner and may be taken on camping trips or hiking in the woods. It sets up in a few seconds, providing instant easy access to everything the painter needs.

This invention enables one to focus more on painting rather than on where to balance and place supplies. The device is compact, having a small footprint, and fits into small spaces such as a tight compact classroom, e.g., for drawing classes, or a small space in a user's house, while providing easy access to many supplies and a large array of brushes.

In one aspect of the present invention, a paint brush holder is provided, comprising: a rigid sheet with a first surface and a second surface, having: a ledge surrounding an aperture configured to accommodate a mouth of a regular mouth mason jar, said ledge recessed with respect to the first surface; grooves extending across a portion of the first surface on a first side of the aperture; and holes extend through the rigid sheet on a second side of the aperture opposite the grooves, said holes having a diameter larger than a smallest diameter of a paint brush handle and smaller than a largest diameter of the paint brush handle.

These and other features, aspects and advantages of the present invention will become better understood with reference to the following drawings, description, and claims.

DETAILED DESCRIPTION OF THE INVENTION

Figure 1:
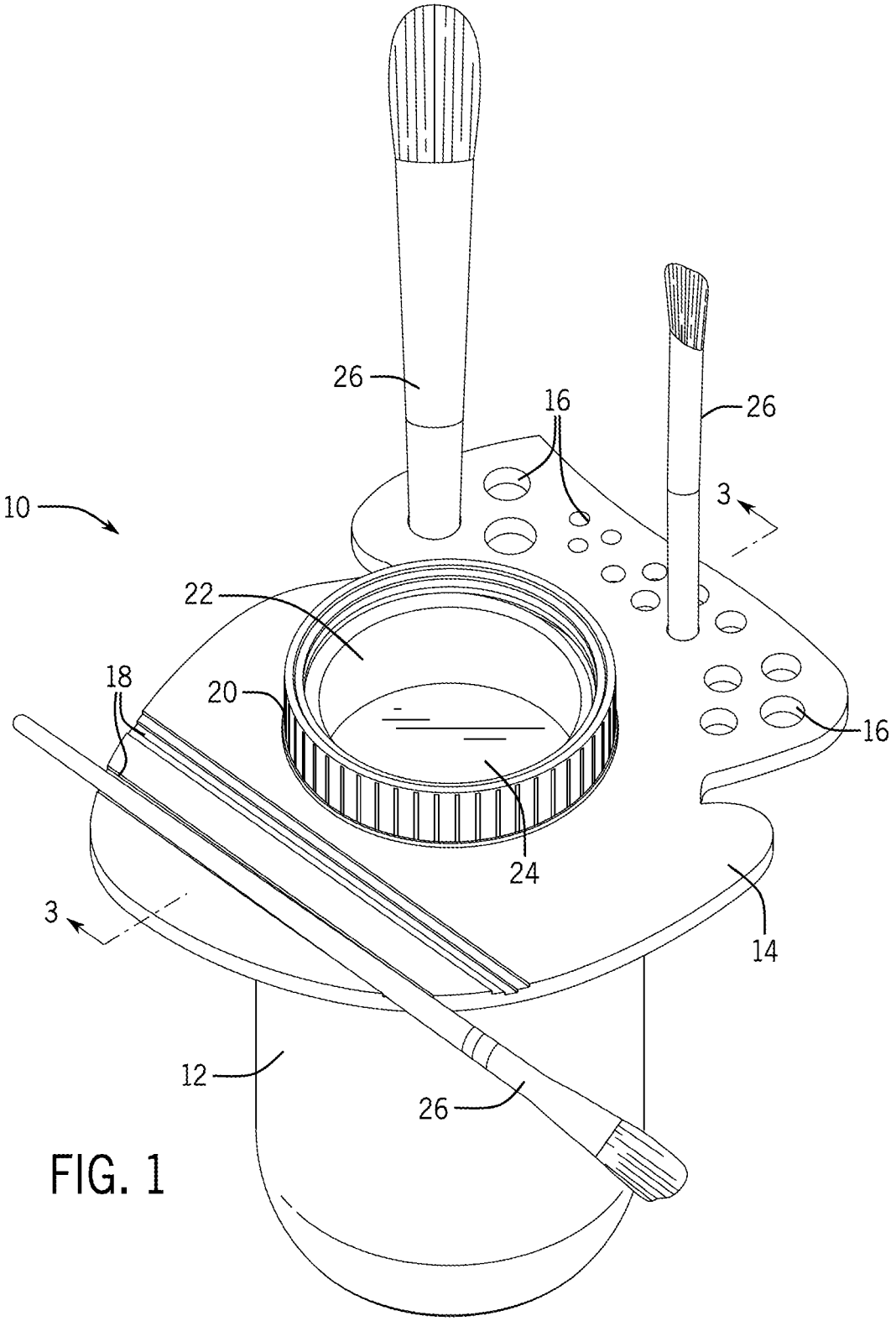
FIG. 1 is a perspective view of a paint brush holder assembly according to an embodiment of the present invention, shown in use.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a unitary paint brush holder couplable to the top of any brand regular mouth Mason Jar and having an array of holes with different sizes. The holes may accommodate any combination of brushes which rest vertically in the holder while it is attached to the mason jar.

The paint brush holder is generally a rigid sheet of material. In some embodiments, the paint brush holder is shaped like a paint palette with about 16 holes of various sizes, designed to fit a full array of paint brush sizes an artist might need for painting a project.

The holes each have a diameter larger than a smallest diameter of a particular paint brush handle and smaller than a largest diameter of the same paint brush handle. Each hole may have a diameter different than or the same as other holes.

In some embodiments, the paint brush holder is substantially rectangular at a first end and substantially circular at the opposite end, with only about 15 variously sized holes to accommodate any brushes in the painter's tool kit.

The paint brush holder has an aperture that lays over the mouth opening of the jar. The threaded band screws down onto a small lip/ledge of the inventive holder surrounding the mouth of the jar such that the threaded band clamps down onto the ledge when the threaded band is screwed onto the Mason Jar. The ledge may be recessed with respect to a first surface of the paint brush holder. The paint brush holder locks into place and does not spin or move.

Two grooves may be etched into the paint brush holder, extending across a portion of the surface, forming a paintbrush rest to accommodate paint brushes in a horizontal position. In some cases, the two grooves may be two parallel sets of grooves. The grooves of the paintbrush rest prevent the brushes from rolling. For example, 1 or 2 paint brushes may be laid onto the etched portion without having to clean them and without getting a counter or table dirty with the paint. The paintbrush rest enables the user to step back to look at work or switch to another brush for a quick change of color or brush size stroke or to add a highlight. The paintbrush rest allows the handle of the paintbrush to rest with its longitudinal axis substantially parallel to a plane of a first surface of the paint brush holder.

Set up is very easy. The user may clamp the paint brush holder to the top of a mason jar with the threaded band and fill the mason jar with water or another cleaning/thinning agent, i.e., the cleaning medium. The user may place the brushes selected for the project upright in the holder holes. The holder may be held in position by the weight of the jar alone or by the weight of the jar filled with water or another solvent.

Cleanup of brushes is also very easy. Start using a brush. Dip the brush into the medium to clean it and either replace the brush into the holder, leave the brush in the water, or lay the brush on the lay flat groove, e.g., while making a quick adjustment or small touch up. The user may select a different brush and add a touch up or highlight, or a quick color change and then may go back to the previously used brush.

In some embodiments, the device comprises an add-on paints attachment configured to hold paint.

The invention may be made of wood, such as ¼"thick plywood, preferably birch or pine. To make a series of paint brush holders, one may cut a wood panel of known dimensions. Multiple templates may be laid out to fit the panel. For example, depending on how flat the panel is, from about 35 up to about 140 pieces may be cut at once. Once the number of holders has been determined and placed spatially on a computer program it may be saved to a file. The file may be downloaded into a Laser Cutting machine. Once activated, the machine cuts out all the holders.

In some embodiments, the paint brush holder may have customized etching.

In some embodiments, the paint brush holder may have customized engraving.

This tool may be used for both water based and oil based paints. Any thinning or cleaning agent may be used and stored in the Glass mason jar.

To use the paint brush holder, the user simply unscrews the cap of their mason jar, places the invention device over the top of the jar, and screws the threaded band down. The user may add water, turpentine, or linseed oil to the jar depending upon whether water-based paint or oil-based paint is used. They may use the paint brush holes to line up all brushes they need for their current project.

Once the user is done, they may remove the threaded band, remove the paint brush holder, and close the lid of the jar, using the threaded band to seal the jar. The user may easily place the holder separately in a bag or purse and carry the jar and holder to the city, on the train, hiking, camping et and travel with their holder anywhere to paint out in nature.

The cleanup is super easy: simply dump the water out and dry the inside of the jar.

Figure 2:
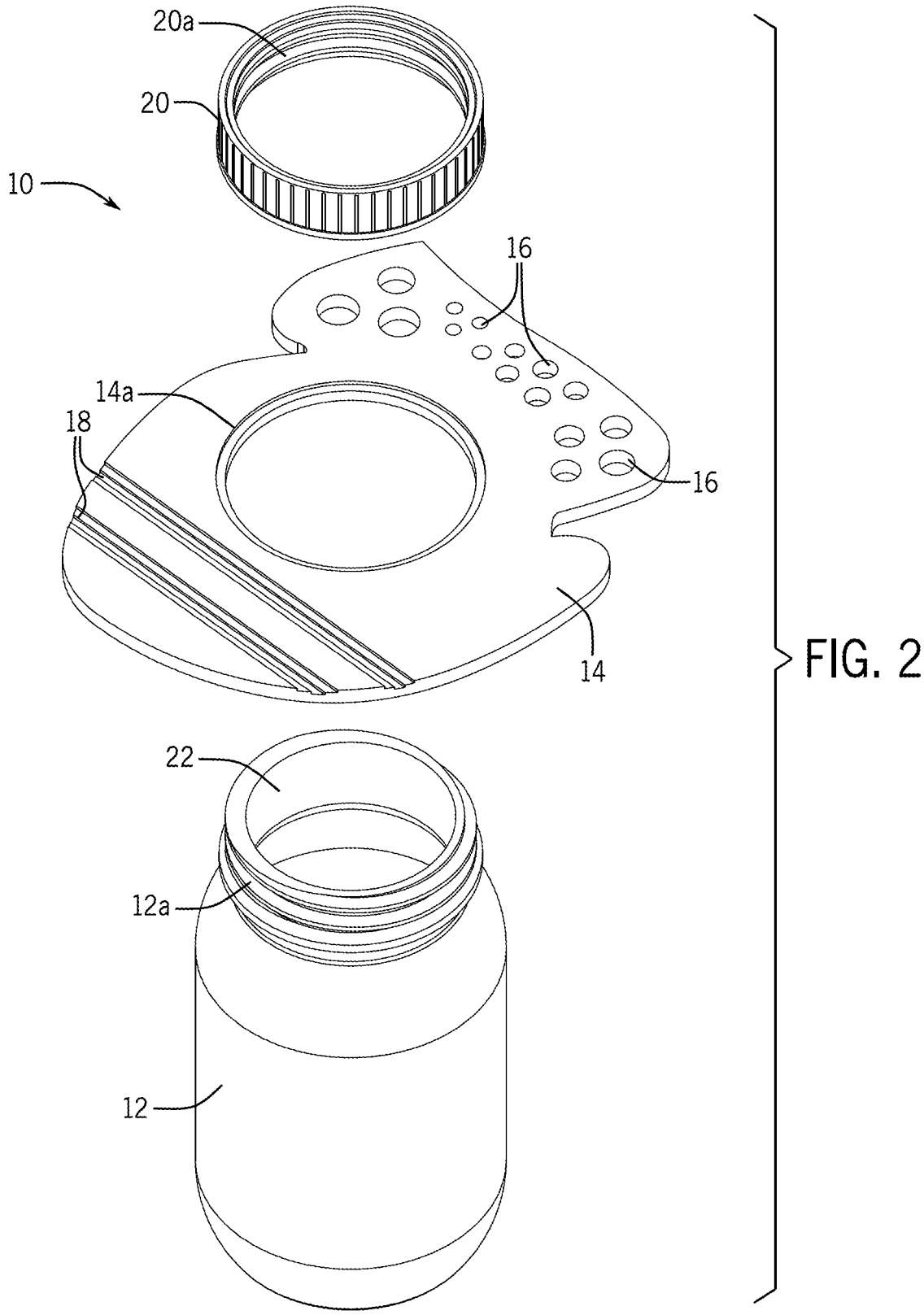
FIG. 2 is an exploded perspective view thereof.
Figure 3:
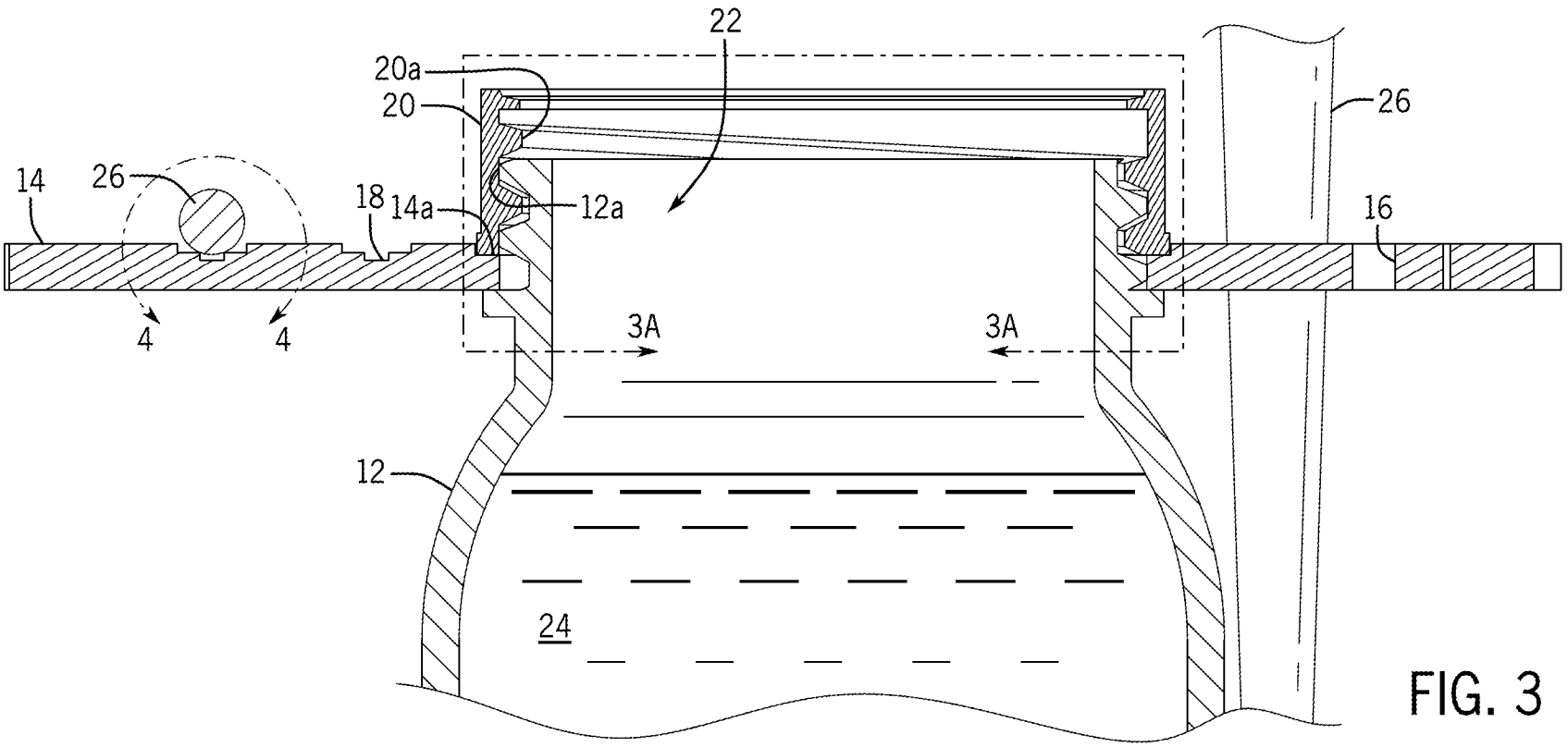
FIG. 3 is a cross-sectional view thereof, taken on line 3-3 of FIG. 1.
Figure 4:
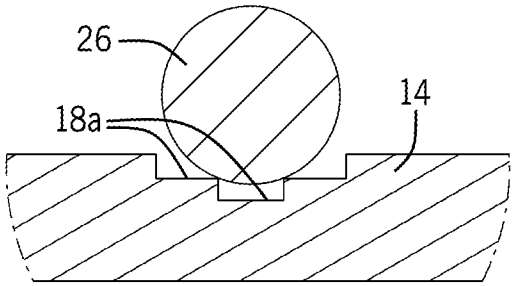
FIG. 4 is a detail cross-sectional view taken on line 4-4 of FIG. 3.
Figure 3A:
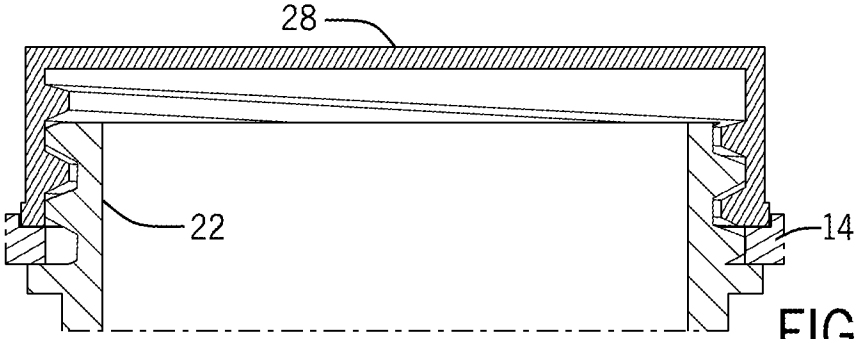
FIG. 3A is a detail cross-sectional view taken on line 3A-3A of FIG. 3.

Referring to FIGS. 1, 2, 3, 3A, 4, 5, and 6, FIG. 1 shows a paint brush holder assembly 10 in use position, with a paint brush holder 14 positioned horizontally around the mouth of a vertically positioned mason jar 12 and held in place with a threaded band 20. The paint brush holder 14 is shown supporting brushes 26 in a vertical position within brush receiving holes 16 and a groove 18 supporting a brush 26 in a horizontal position, shown in detail in FIG. 4. The jar 12 is shown containing solvent 24 accessible through the opening 22 for use with the brushes 26. As shown in FIGS. 2 and 3, the paint brush holder 14 is held in place securely on the jar 12 by the threaded band 20 which is seated on a relieved closure surface 14*a*, i.e., a ledge or lip. The threaded band 20 internal threads 20*a* screw onto the jar 12 external threads 12*a*. An inner diameter of the internal threads 20*a* of the threaded band 20 corresponds to an outer diameter of the jar's 12 external threads 12*a*, i.e., the dimensions are very close. To prevent spills in transit, the jar 12 may be sealed with a lid or threaded cap 28, as shown in FIG. 3A.

Figure 5:
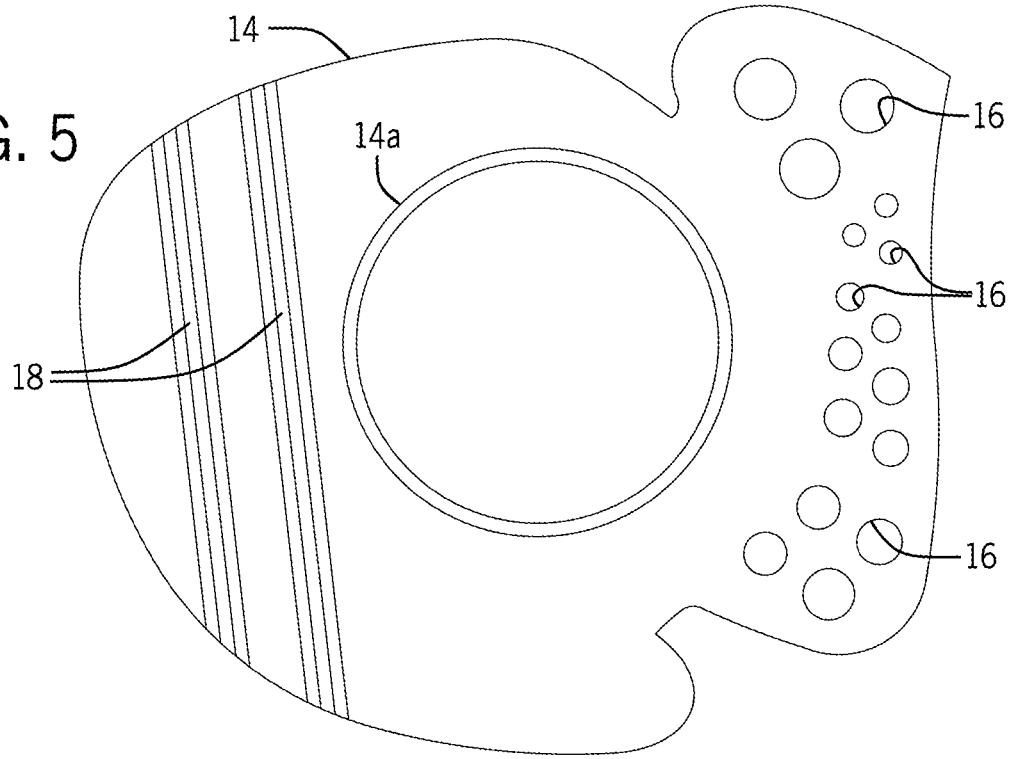
FIG. 5 is a top plan view of a paint brush holder thereof.
Figure 6:
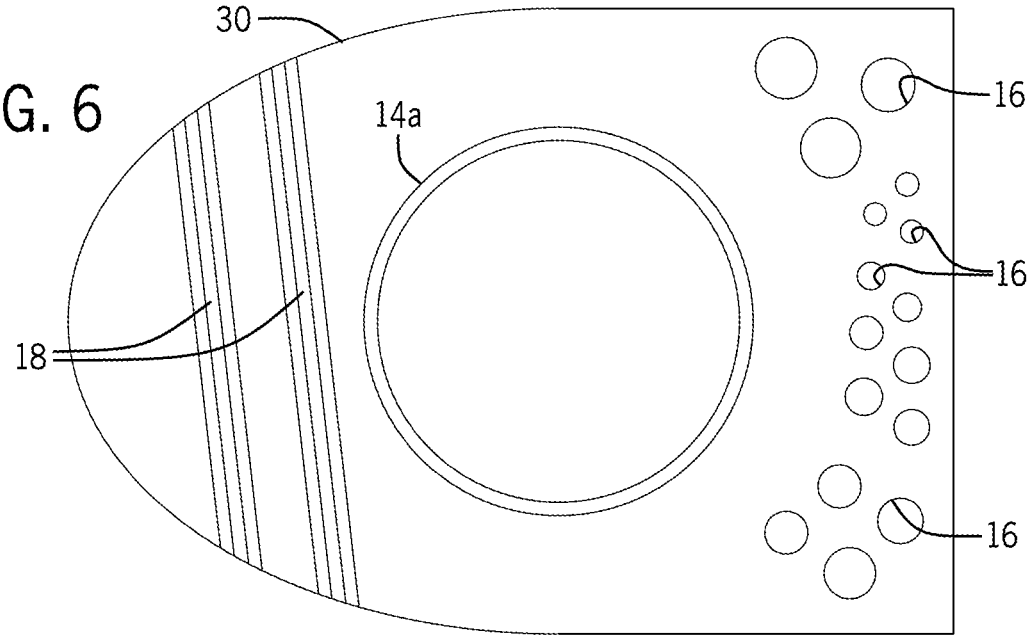
FIG. 6 is a top plan view of paint brush holder according to another embodiment of the present invention.

FIGS. 5 and 6 show two embodiments of a paint brush holder according to the present invention. The paint brush holder 30 of FIG. 6 has a rectangular shape at a first end, tapering to a rounded shape at a second end, while the paint brush holder 14 of FIG. 5 has a shape similar to a paint palette. In other words, the perimeter of the paint brush holder 14 is curved and is recessed on two sides adjacent to the holes 16. Both paint brush holders 14, 30 have a recessed ledge 14*a* configured to encircle the mouth of a jar 12, a plurality of holes 16 to support paint brushes in a vertical position, and grooves 18 to support paint brushes in a horizontal position.

It should be understood, of course, that the foregoing relates to exemplary embodiments of the invention and that modifications may be made without departing from the spirit and scope of the invention as set forth in the following claims.

What is claimed is:

1. A paint brush holder comprising:

a rigid sheet with a first surface and a second surface, the rigid sheet having:

an aperture with a diameter configured to accommodate a mouth of a regular mouth mason jar, a ledge recessed with respect to the first surface and surrounding the aperture;

grooves extending from a first edge to a second edge across a first portion of the first surface, the first portion located adjacent to one side of the aperture; and holes extend through the rigid sheet on a second portion of the first surface, the second portion located on an opposite side of the aperture from the grooves, the holes configured to accommodate paint brush handles.

2. The paint brush holder of claim 1, wherein the diameters of the holes vary.

3. The paint brush holder of claim 1, wherein the grooves are configured to accommodate at least one paint brush handle in a position such that a longitudinal axis of the paint brush handle is parallel to a plane of the first surface.

4. The paint brush holder of claim 1, wherein the grooves are parallel to each other.

5. The paint brush holder of claim 1, wherein the ledge has an inner diameter corresponding to an outer diameter of the mouth and smaller than the outer diameter of a threaded band surrounding the mouth.

6. The paint brush holder of claim 1, wherein the rigid sheet is substantially rectangular at a first end and substantially circular at a second end opposite the first end.

7. The paint brush holder of claim 1, wherein the rigid sheet has a curved perimeter recessed on two sides adjacent to the holes.

* * * * *